US012687161B2

(12) United States Patent
Mou

(10) Patent No.: US 12,687,161 B2
(45) Date of Patent: Jul. 21, 2026

(54) PERISTALTIC PUMP TUBING MOUNT AND ITS USE

(71) Applicant: Duen Gang Mou, Taipei (TW)

(72) Inventor: Duen Gang Mou, Taipei (TW)

( * ) Notice: Subject to any disclaimer, the term of this patent is extended or adjusted under 35 U.S.C. 154(b) by 61 days.

(21) Appl. No.: 18/237,476

(22) Filed: Aug. 24, 2023

(65) Prior Publication Data

US 2024/0077070 A1 Mar. 7, 2024

(30) Foreign Application Priority Data

Sep. 6, 2022 (TW) ..... 111133774

(51) Int. Cl.

| | |
|---|---|
| ***F04B 43/12*** | (2006.01) |
| ***F04B 53/00*** | (2006.01) |
| ***F04B 53/16*** | (2006.01) |
| *F04B 53/22* | (2006.01) |

(52) U.S. Cl.

CPC ..... *F04B 43/12* (2013.01); *F04B 53/16* (2013.01); *F04B 43/1253* (2013.01); *F04B 53/22* (2013.01)

(58) Field of Classification Search

CPC ..... F04B 43/12; F04B 43/1253; F04B 53/16; F04B 53/22

See application file for complete search history.

(56) References Cited

U.S. PATENT DOCUMENTS 3,826,593 A * 7/1974 Von Casimir ..... F04B 11/0075 417/477.1
4,184,815 A * 1/1980 Casson ..... F04B 43/1276 604/153
5,701,646 A * 12/1997 Nabity ..... F04B 43/12 29/25.35
7,722,338 B2 * 5/2010 Nordell ..... F04B 43/1253 417/477.2
8,128,384 B2 3/2012 Mou

FOREIGN PATENT DOCUMENTS

CN 200910149538.8 5/2005
CN 202120104838.0 1/2021
DE 102004024102.3 5/2004
ES 2985634 T3 * 11/2024 ..... A61M 5/14232

OTHER PUBLICATIONS

Translation of ES 2985634 (Year: 2024).*

* cited by examiner

*Primary Examiner* — Charles G Freay
(74) *Attorney, Agent, or Firm* — PAI PATENT & TRADEMARK LAW FIRM; Chao-Chang David Pai

(57) ABSTRACT

Peristaltic pump's tubing mount design in this invention uses an "&"-shape tubing routing path to hold a longer tubing section on its entry side to spread pumping motion's shear stress, hence a reduced tubing deformation rate and longer tubing life. Together with a fixed-speed synchronous AC motor, this minimum tubing mount arrangement makes a light weight peristaltic pump of easy tubing mount and dismount and zero-footprint hanging use conveniences, hence added reaches and applications.

12 Claims, 3 Drawing Sheets

--PRIOR ART--

--PRIOR ART--

PERISTALTIC PUMP TUBING MOUNT AND ITS USE

CROSS-REFERENCES TO RELATED APPLICATIONS

This application claims priority of Taiwan Patent Application No. 111133774 filed on Sep. 6, 2022, the entirety of which is incorporated by reference herein.

BACKGROUND OF THE INVENTION

(a) Field of the Invention

This invention is about the design of a peristaltic pump tubing mount to mount one continuous tubing piece for fluid delivery.

(b) Description of the Related Art

Peristaltic pump is usually composed of an electric motor, a pump head, a continuous tubing piece for fluid delivery, and a tubing mount. The tubing mount is stationary and holds the continuous tubing piece going into and out of the pump head. The electric motor is the power, the pump head carries inside its case a rotor which rotates two or more equally spaced, usually spring-loaded, free-rotating driver wheels which then press and grind the continuous tubing piece against a tubing track wall lining inside the pump head case, and liquid in between two neighboring driver wheels is pressed and then transmitted forward in the continuous tubing piece. It is an ideal sanitary pump because the fluid is not in contact with any pump parts.

To keep the continuous tubing piece stay with the pump and not move with the pulling friction force from the driver wheels, inlet end of the continuous tube piece must be anchored to a tubing mount next to the pump head so that there is no relative displacement between the continuous tubing piece and the pump. This is critical because a moving tubing piece may pull and break the tube plumbing from its fluid source. Some pump anchors or "hard wires" a short finite section of pumping tube inside the pump head, hence separate itself from the transporting tube, i.e., separate feeding (inlet) and bleeding (outlet) tube sections; while most other pumps anchor one continuous tubing piece through the pump head. This invention is about the latter.

When one continuous tubing piece is used through a pump head, its inlet section inside the pump head is the tubing piece between an anchoring press on a tubing mount and the first driver wheel coming to contact when pumping. The outlet section is the tubing piece between the last driver wheel departing the contact when pumping and an outlet guiding port on the same or a separate tubing mount if needed. The outlet guiding port on the tubing mount is of an auxiliary function by directing, not pressing or anchoring, the outlet section of the continuous tubing piece to avoid kink and entanglement while leaving the pump head. In between inlet and outlet is the tube pumping section which stays in contact with the driver wheels and takes the friction forces in between the driver wheels and tubing track wall inside the pump head case—either the tubing track wall or the driver wheels are loaded on springs to maintain the pressure pressing and sealing the tubing piece in between them.

The tubing track wall may be on two or three sides of the pump head. The top-and-bottom two-side pump head has the tubing track wall encased on one side of the pump head and the pump rotor and driver wheels on the other side, The two opposing sides press and lock onto each other to mount the continuous tubing piece in a horizontal direction. The three-side pump head usually has a U-shaped tubing track wall to encase the driver wheels and the pumping section of the continuous tubing piece. A tubing mount would be at the open side of the U-shape tubing track wall or the $4^{th}$ side of the pump head to press and anchor the inlet section of the continuous tubing piece on one end of the tubing mount while guide the outlet section of the continuous tubing piece leaving the pump head on an other end. The two-sided pump head in general has a straight tubing path through the pump head, while the three-sided a 180-degree U-turn tubing path, and in either, the inlet and the outlet tubing paths do not cross one another.

In above design shear stress on pumping section of the continuous tubing piece must be absorbed by the inlet section of the tube after the tubing mount. Since the inlet section is of a limited length, hence a high-grade tubing of a high elasticity, or tensile strength, and stiffness is required for reduced tubing deformation and longer tubing service life. Tubing deformation collapses pumping section of the tube, hence reduces pumping tube's chamber size and fluid flow inside the tube—not desirable for precision fluid delivery. Lower quality or tensile strength tubing in general is not a match for the above design and application. This inventor addressed part of the issue in U.S. Pat. No. 8,128,384 in shear stress reduction by using an adjustable torsion spring to load the tubing track wall onto the driver wheels of the pump rotor.

BRIEF SUMMARY OF THE INVENTION

This invention deals on a new tubing mount design and a new tube routing arrangement to spread and reduce the shear strain effect after the anchoring press on the tubing mount by arranging an additional tubing slack to the inlet section of the continuous tubing piece to reduce tubing deformation, steady the fluid pumping rate, and extend tubing service life. Low grade or low tensile strength tubing can then be used in one continuous piece as a regular for both pumping and transport function.

This new tubing mount design and tube routing arrangement come also with easier free hand anchoring and mounting of the continuous tubing piece on pump. Further weight reduction of the electric motor produces a peristaltic tubing pump light enough for in air hanging use with zero foot print, in addition to other uses as a peristaltic pump assembly unit.

BRIEF DESCRIPTION OF THE DRAWINGS

Clear understanding of this invention comes from in-depth description coupled with illustration by drawings and practical examples. Their layout and depiction are made to reveal unique features of the invention and may not limit its practice in specifics such as size, shape, dimension and their geometric ratios, and in changes made without departing from the spirit of the invention by people skilled in the art.

DETAILED DESCRIPTION OF THE INVENTION

Figure 1:
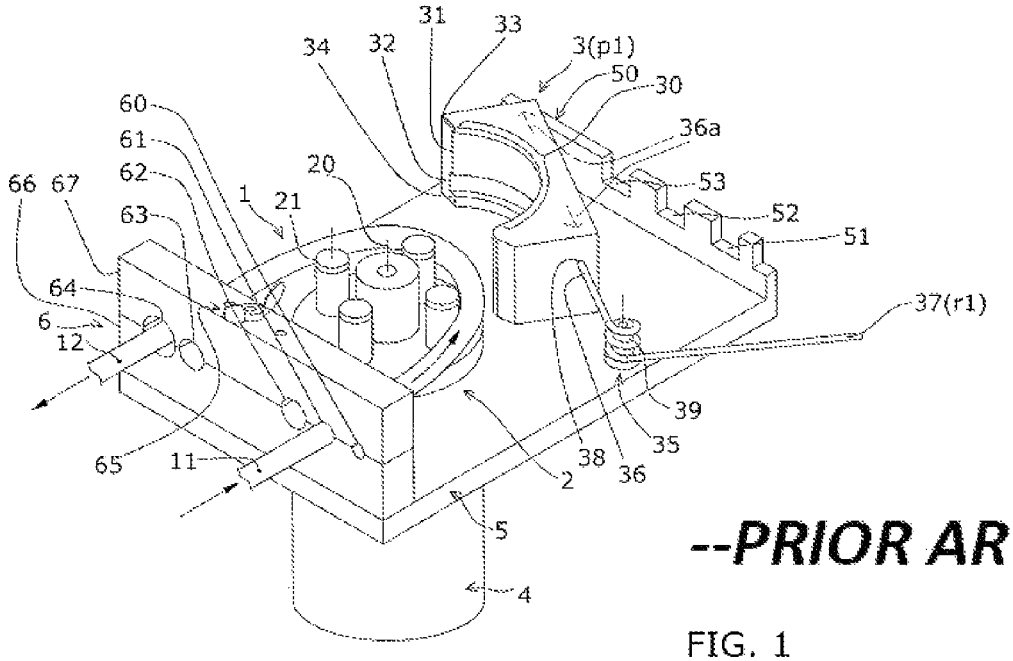
FIG. 1 is a peristaltic tubing pump with a U-shaped pump head and tubing route, together with a tubing mount to anchor and guide the one continuous tubing piece, with the pump head open in a loading position (drawing from U.S. Pat. No. 8,128,384 FIG. 1)
Figure 2:
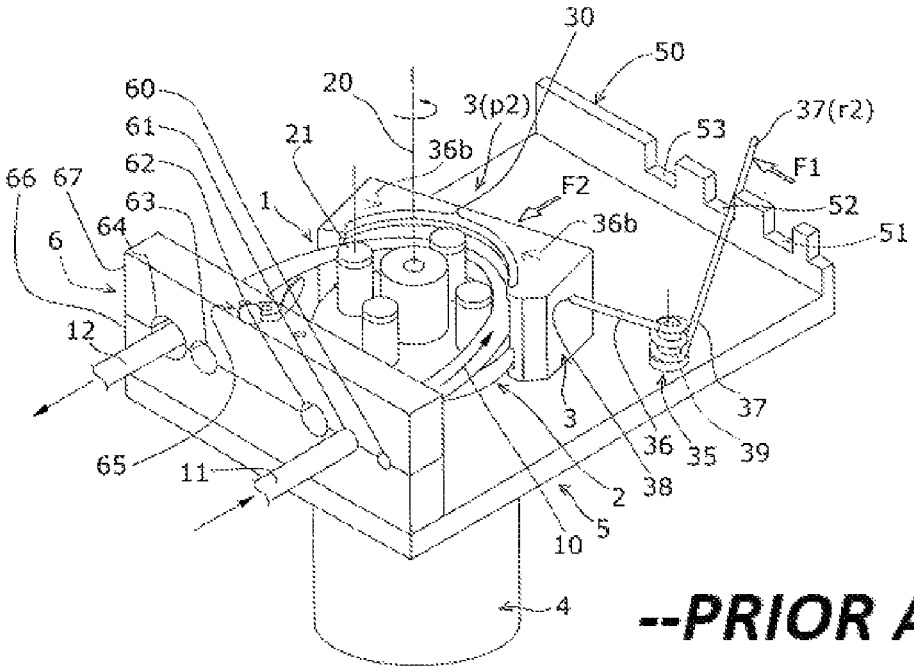
FIG. 2 is a peristaltic tubing pump with a U-shaped pump head and tubing route, together with a tubing mount to anchor and guide the one continuous tubing piece, with the pump head press-closed in a running position (drawing from U.S. Pat. No. 8,128,384 FIG. 2)

FIG. 1 shows a peristaltic tubing pump assembly with its essential components of (1) pump head including the opened torsion-spring 35-pressed wall plate 3, the pump rotor 2 and the equally spaced 4 driver wheels 21, (2) tubing mount 6, (3) one continuous tubing piece 1, (4) electric motor 4, and (5) base plate 5 to mount all above, as the embodiment described in FIG. 1 in U.S. Pat. No. 8,128,384. While FIG. 2 shows above assembly with curved part of the wall plate 3 press-closed onto pumping section 30 of the tubing piece 1 in pump running mode, as the same embodiment described in FIG. 2 in U.S. Pat. No. 8,128,384. Before pumping section 30 is inlet section 11, and after outlet section 12 portions of the tubing piece. Tubing mount 6 anchors, at port 61, and guides, at port 64, the U-shape routing of the tubing piece 1 (circling the pump rotor 2) respectively at its in-flow inlet and out-flow outlet. Tubing 10, the inlet section tubing piece at the pump head side, i.e., the distance between the two pressing points, i.e., one at the driver wheel 21 when coming into full contact at entry point of the pumping tube section 30 and one at the fixed anchor point 61 on tubing mount 6, is of limited length and has to bear entire shear stress coming from pumping section of the tube 30 as pointed out earlier. Tubing deformation as a result may collapse pumping section of the tube 30, hence reduced pumping chamber size and flow inside the tube—not desirable for precision fluid delivery. Lower quality or tensile strength tubing in general is not a match or option for the above design and application. This is a common situation with other peristaltic pumps using a U-shape pump heads, which often engaging more driver wheels.

The tubing mount design of this invention introduces a novel tube routing arrangement to add to the length of the inlet tube section inside the pump head to buffer the shear stress or spread the shear strain from pumping section of the tube 30. Reduced tubing deformation, as a result, gives better pumping flow rate control and longer tube service life. Hard pressure anchor of the tubing mount 6 are also spared because of substantially reduced shear stress and shear strain at head of the tube inlet port 61.

Figure 3:
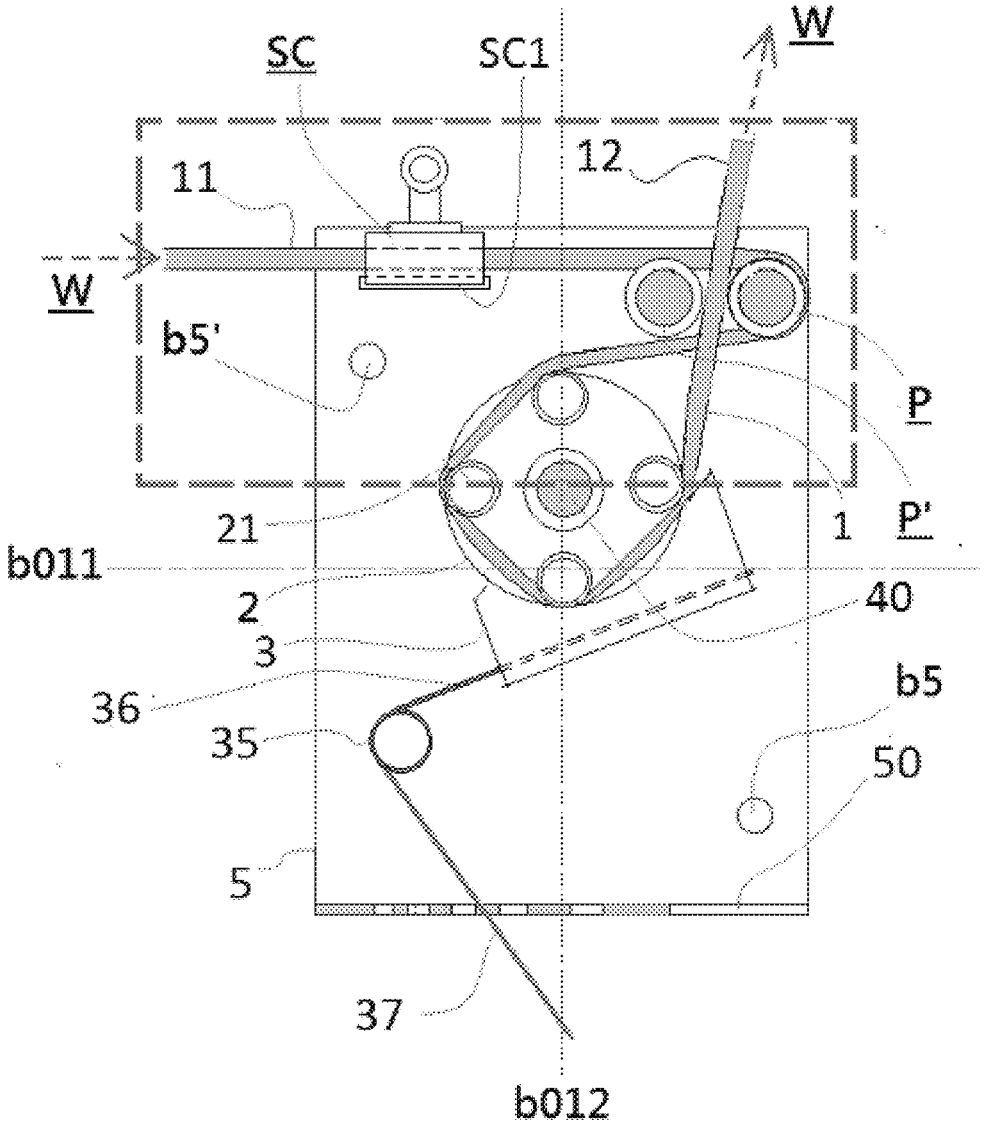
FIG. 3 is a schematic layout of the peristaltic pump tubing mount (inside the dotted line box) and tube routing of this invention (assigned for cover page)

One such embodiment is shown in FIG. 3 with the dotted-line box highlighting the tubing mount design of this invention. The schematic top-view layout has the peristaltic pump in FIG. 2 mounted on a 4-side base plate 5 with two parallel short sides and two parallel long side, they each respectively have lines of symmetry b011 and b012 which intersect one another at a right angle at base plate 5 center point. At or near the center point holds elements of the pump head including pump rotor 2, driver wheels 21, tube-pressing wall plate 3 on torsion spring 35, with pump rotor 2 mounted on an electric motor 4's turning shaft 40 on turning axis 20 coming from behind the base plate 5. Common peristaltic pumps' pump heads may use a top-and-bottom 2-side or a U-shape 3-side tube-pressing wall plate for the same purpose.

Tubing mount design and tube routing arrangement of this invention highlighted inside the dotted line box in FIG. 3 has fluid W in inlet tube 11 spring-clip-held to one end of a top edge of the base plate 5 with a light bulldog-clip like spring clip SC and a thin open slot SC1 parallel to and along the top edge of the base plate 5 for the spring clip SC to bite into; a round stationary post P vertically planted at an other end of the top edge of the base plate 5, and when needed, a second round post P' vertically planted inside of the far end post P, both with a circular top flange, help to route and add an additional length to the inlet section of the continuous tubing piece by making a 180-degree turn on the post P before engaging the driver wheels 21*s*; this continuous tubing piece then in a near complete turn around the four driver wheels 21*s* gives also a longer pumping tube section 30 or a larger pumping-tube-and-driver-wheels contact angle than prior art as presented in FIG. 2; continuous tubing piece 1, now the outlet tube section 12, continues on and snakes in between the two vertical posts P and P' before departing the pump for fluid transport. Above tube routing arrangement, if reversed from the outlet tube section at the two vertical posts P and P' back to the inlet tube section at the spring clip SC and the thin open slot SC1, will also work, only with the outlet tube section now crossed under the inlet tube section in between the two vertical posts P and P'. Post P' also serves as an alternate post P for a U-turn routing when needed.

More post P' for tube routing may be added to bear the shear stress and aid shear strain relief. Posts P and P' in FIG. 3 have a minimum gap equal or larger than one tube diameter to allow tube routing in between. To allow both inlet and outlet tube sections to route or snake through, minimum height of posts P and P' is twice the tube diameter. Said tube diameter is the maximum tube diameter the pump head or the tubing track wall can run. The stationary 180-degree U-turn post P, according to tube size and tube wall thickness, requires a minimum post diameter to not smother the fluid flow when running. For tube diameter of 3 to 6 mm and wall thickness of 1 mm, tests indicated this minimum post diameter is no less than 8 mm. Spring clip SC and its anchoring open slot SC1 on one edge of the base plate 5 may be aided or replaced with tube pinching and snaking slots carved out on the same edge of the base plate 5.

Embodiment of this invention shown in FIG. 3 changes the common tubing mount of prior art of an U-shape tube routing arrangement in FIGS. 1 and 2, where the inlet tube section and outlet tube section do not cross, into an "&"-shape tube routing arrangement, where the two tube sections cross one another: top loop of "&" wraps around the pump rotor 2 and all its driver wheels 21*s*, and the bottom loop of "&" U-turns the post P. As a result, the inlet section length of tubing piece 1 between tubing mount spring clip SC and driver wheel 21 is substantially extended to spread the pumping stress. Greater length of the pumping tube section 30 by engaging all 4 driver wheels 21 at all time also spreads the shear stress and shear strain on the pumping tube section. The "&"-shape tube routing arrangement of this invention therefore reduces tubing deformation, steadies the fluid pumping rate, and extends tubing service life. Low grade or low tensile strength tubing can then be used in one continuous piece for both fluid pumping and transport function, hence an invention for a high C/P value product.

With the new tubing mount design and tube routing arrangement, embodiment in FIG. 3 are particularly suitable for light weight, small diameter tubing and fixed flow rate application. When equipped with a low RPM (round per minute) fixed speed synchronous AC motor, the entire pump weighed about 300-g and measured 5-cm thick. Synchronous AC motor operates at a constant speed (i.e., synchronous speed) from no-load to full-load on regular AC power of 50 or 60 Hz. For low speed application, synchronous AC motors are also more economical. One such peristaltic pump is shown in FIG. 4 with the entire pump components mounted on top side of a base plate 5 about size of the playing card, and the synchronous AC motor mounted on the bottom side and visible only by its 4-mounting screws 41, 42, 43, 44 and rotating shaft 40.

Tubing mount design of this invention allows easy anchoring and routing of one continuous tubing piece onto the pump head in air and free hand. Further adoption of a synchronous AC motor produces a peristaltic tubing pump light enough to be hung in air with zero foot print, such as over a lab bench, on an angle iron frame or steel wire shelf, inside an incubator, above a shaker table, etc., in addition to other uses as a component for a peristaltic pump assembly. Hanging hook holes or panel mounting holes are b5 and b5' on base plate 5 in FIGS. 3 and 4. The two mounting holes b5 and b5' on the base plate can also be used to string the pump in multiples as a pump cassette in parallel.

Figure 4:
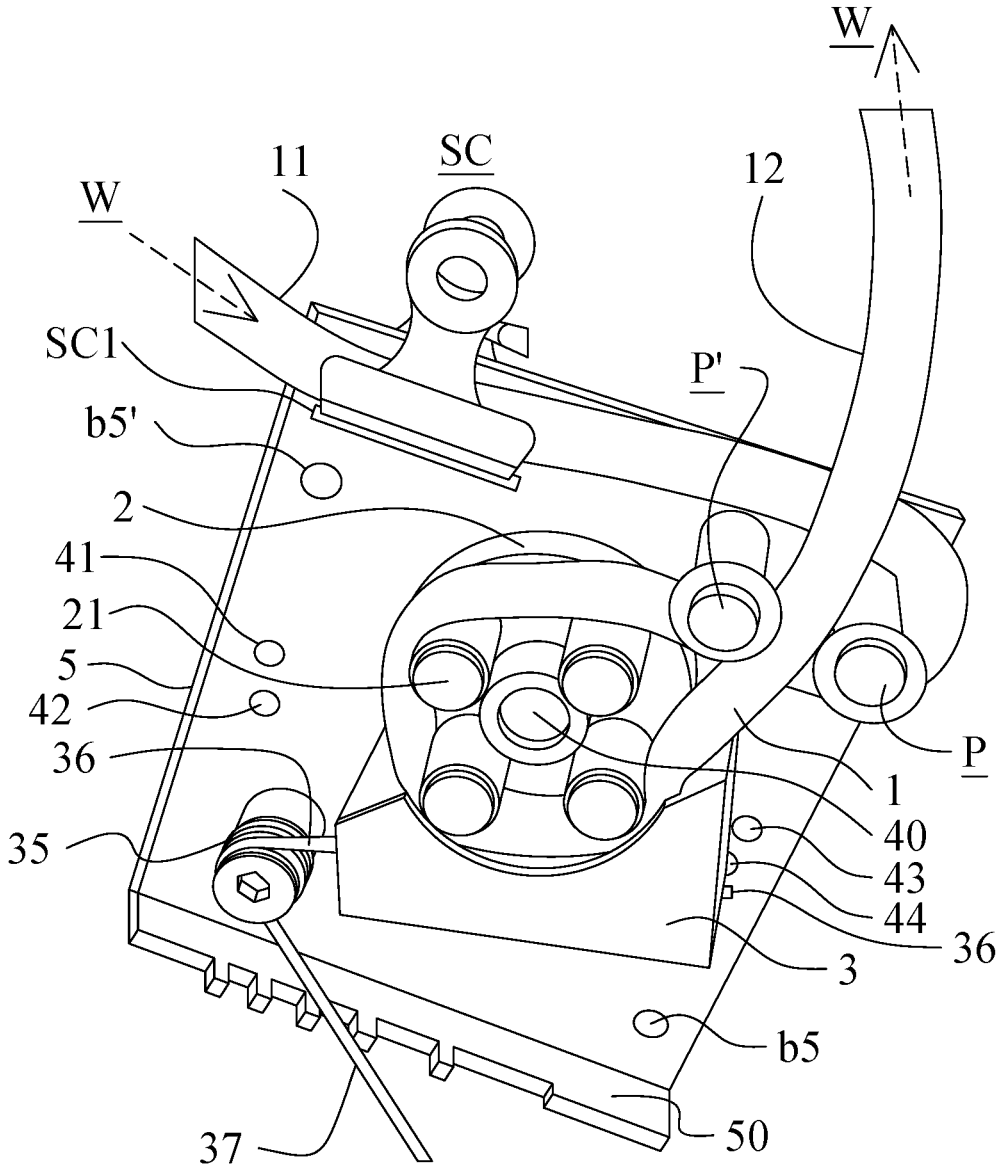
FIG. 4 is photo of one actual prototype of FIG. 3 in approximately 1:1 scale of the use of this tubing mount invention

In air and free hand tube loading of one single continuous tubing piece to the tubing mount design of this invention is like the following: hold tubing 1 at its inlet section 11 and the pump in FIG. 4 in one hand, and bound the two together with spring clip SC biting into slot SC1 on base plate 5, then open tube-pressing wall plate 3 by releasing the torsion spring 35 at its arm 37, followed by the "&"-shape tube routing arrangement of a 180-degree U-turn at post P, then a near complete turn around the pump rotor driver wheels 21 before snaking through the gap between posts P and P', the torsion spring arm 37 and tube-pressing wall plate 3 are then reloaded by engaging respectively the locking slot on base plate bend 50 and the pump rotor 2, and the pump is ready to run.

I claim:

1. A tubing mount arrangement for a peristaltic pump assembly, the peristaltic pump assembly including a pump head, a continuous tubing piece, a driver motor and the tubing mount arrangement, wherein the tubing mount arrangement comprises:

a base plate configured to have the pump head, the continuous tubing piece and the driver motor mounted thereon; and an inlet end tube anchoring device being mounted adjacent a first side-edge of the base plate and being configured to holding the continuous tubing piece on the base plate; and at least one tube routing device mounted adjacent a second side-edge of the base plate, the second side-edge being opposite to the first side-edge;

wherein the base plate is configured to have the inlet end tube anchoring device, the at least one tube routing device and the pump head mounted thereto such that when the continuous tubing piece is routed thereon the continuous tubing piece will extends from the inlet end tube anchoring device to wind in a U-turn around the at least one tube routing device, and then pass around a rotor of the pump head to form an "&"-shape tubing path, with a tube routing section around the at least one tube routing device corresponding to a bottom loop of the "&"-shape and another tube routing section around the rotor of the pump head corresponding to a top loop of the "&"-shape.

2. The tubing mount arrangement of claim 1, wherein the at least one tube routing device is a round-shape post fixedly and vertically mounted on the base plate, and has a minimum height of twice the diameter of the continuous tubing piece and a flanged top.

3. The tubing mount arrangement of claim 1, wherein the at least one tube routing device has two round-shape posts fixedly and vertically mounted on the base plate, each having a minimum height of twice the diameter of the continuous tubing piece and a flanged top; wherein the two round-shape posts are placed apart by at least one diameter of the continuous tubing piece and in line with the inlet end tube anchoring device.

4. The tubing mount arrangement of claim 1, wherein the inlet end tube anchoring device uses a T-shaped spring clip and a spring clip sitting slot carved out adjacent the first side-edge of the base plate, to fasten and unfasten the spring clip in order to hold or release respectively an inlet tube section of the continuous tubing piece in one step.

5. The tubing mount arrangement of claim 1, wherein the base plate is a metal plate of a rectangular or parallelogram shape.

6. The tubing mount arrangement of claim 5, wherein the base plate is made of stainless steel.

7. A peristaltic pump assembly, comprising:

a pump head;

a continuous tubing piece;

a driver motor; and a tubing mount arrangement, wherein the tubing mount arrangement comprises:

a base plate on which the pump head, the continuous tubing piece and the driver motor are mounted;

an inlet end tube anchoring device being mounted adjacent a first side-edge of the base plate and holding the continuous tubing piece on the base plate; and at least one tube routing device mounted adjacent a second side-edge of the base plate, the second side-edge being opposite to the first side-edge;

wherein the continuous tubing piece extends from the inlet end tube anchoring device to wind in a U-turn around the at least one tube routing device to form an "&"-shape tubing path, with a tube routing section around the at least one tube routing device corresponding to a bottom loop of the "&"-shape and another tube routing section around the rotor of the pump head corresponding to a top loop of the "&"-shape.

8. The peristaltic pump assembly of claim 7, wherein the at least one tube routing device of the tubing mount arrangement is a round-shape post fixed and vertically mounted on the base plate, and has a minimum height of twice the diameter of the continuous tubing piece and a flanged top.

9. The peristaltic pump assembly of claim 7, wherein the at least one tube routing device of the tubing mount arrangement has two round-shape posts fixedly and vertically mounted on the base plate, each having a minimum height of twice the diameter of the continuous tubing piece and a flanged top; wherein the two round-shape posts are placed apart by at least one diameter of the continuous tubing piece and in line with the inlet end tube anchoring device.

10. The peristaltic pump assembly of claim 7, wherein the inlet end tube anchoring device of the tubing mount arrangement uses a T-shaped spring clip and a spring clip sitting slot carved out adjacent the first side-edge of the base plate, to fasten and unfasten the spring clip in order to hold or release respectively an inlet tube section of the continuous tubing piece in one step.

11. The peristaltic pump assembly of claim 7, wherein the base plate of the tubing mount arrangement is a metal plate of a rectangular or parallelogram shape.

12. The peristaltic pump assembly of claim 11, wherein the base plate of the tubing mount arrangement is made of stainless steel.

* * * * *